US010694922B1

(12) United States Patent
Audibert et al.

(10) Patent No.: US 10,694,922 B1
(45) Date of Patent: Jun. 30, 2020

(54) DRINKING STRAW CLEANING CADDY

(71) Applicant: Pacific Biomedical Solutions, Inc., Huntington Beach, CA (US)

(72) Inventors: Ken Audibert, Ladera Ranch, CA (US); Jamie Fischer, Mission Viejo, CA (US); Greg Angelovic, Huntington Beach, CA (US)

(73) Assignee: 4 R Oceans, LLC, Mission Viejo, CA (US)

( * ) Notice: Subject to any disclaimer, the term of this patent is extended or adjusted under 35 U.S.C. 154(b) by 0 days.

(21) Appl. No.: 15/963,012

(22) Filed: Apr. 25, 2018

(51) Int. Cl.
*B01L 9/06* (2006.01)
*A47L 15/50* (2006.01)

(52) U.S. Cl.
CPC ..... *A47L 15/505* (2013.01); *B01L 9/06* (2013.01)

(58) Field of Classification Search
CPC ..... A47L 15/505; A47L 15/50; A47L 15/502; B25H 3/04; B25H 3/00; B01L 9/06
USPC ..... 211/74, 41.5–41.8
See application file for complete search history.

(56) References Cited

U.S. PATENT DOCUMENTS 1,188,146 A * 6/1916 Bogley ..... A47B 73/00 211/74
3,113,689 A * 12/1963 Moussong ..... B65D 25/108 206/3
3,375,934 A 4/1968 Bates
3,379,315 A * 4/1968 Broadwin ..... B01L 3/0217 211/189
3,643,812 A * 2/1972 Mander ..... B01L 9/06 206/443
4,003,713 A * 1/1977 Bowser ..... B01D 1/00 422/528
4,124,122 A * 11/1978 Emmitt ..... B01L 9/06 211/74
4,281,768 A * 8/1981 Sommers ..... B01L 9/06 211/74
4,346,057 A * 8/1982 Bowser ..... B01L 9/06 159/22
4,389,374 A 6/1983 Sutton et al.
4,407,958 A * 10/1983 DeGraff, Jr. ..... B01L 9/06 211/194
4,495,150 A * 1/1985 Cook ..... B01L 9/06 134/115 R (Continued)

FOREIGN PATENT DOCUMENTS

DE 202019104788 U1 * 9/2019 ..... A47L 15/505
DE 202019104789 U1 * 9/2019 ..... A47L 15/505
WO WO-2017158947 A1 * 9/2017 ..... B01F 11/0008

OTHER PUBLICATIONS

U.S. Appl. No. 16/237,514, filed Dec. 31, 2018 Non-Final Office Action dated Apr. 4, 2019.

*Primary Examiner* — Kimberley S Wright
(74) *Attorney, Agent, or Firm* — Rutan & Tucker, LLP

(57) ABSTRACT

Apparatus and methods for a reusable drinking straw cleaning caddy are disclosed. Such caddies maintain reusable straws in an orientation parallel to the flow of cleaning fluids and promote efficient cleaning of the straw along both the inner and outer surfaces of the straw. Such caddies may be used with commercial dishwashing trays and may include handles for ease of retrieval from the trays. Such caddies may promote the use of reusable drinking straws, reducing the amount waste associated with disposable drinking straws and the associated environmental problems.

22 Claims, 10 Drawing Sheets

(56) References Cited

U.S. PATENT DOCUMENTS 5,076,445 A * 12/1991 Landsberger ..... B01L 9/06 211/60.1
5,098,663 A * 3/1992 Berthold ..... B01L 9/06 422/561
5,114,680 A 5/1992 Obermiller et al.
5,128,105 A * 7/1992 Berthold ..... B01L 9/06 422/561
5,133,939 A * 7/1992 Mahe ..... B01L 9/06 211/74
5,169,603 A * 12/1992 Landsberger ..... B01L 9/06 211/74
5,180,555 A * 1/1993 Monget ..... B01L 3/508 356/246
5,266,272 A * 11/1993 Griner ..... B01L 3/50853 211/126.1
5,372,252 A * 12/1994 Alexander ..... A61M 5/001 206/210
5,860,627 A * 1/1999 Edwards ..... B65D 85/20 248/68.1
5,967,318 A * 10/1999 Rosler ..... B25H 3/003 206/372
5,993,745 A * 11/1999 Laska ..... B01L 9/06 206/446
5,996,818 A * 12/1999 Boje ..... B01L 9/06 206/443
6,135,296 A * 10/2000 Colgrove ..... A47L 15/505 211/41.8
6,202,862 B1 * 3/2001 Acquaviva ..... B43K 21/003 211/60.1
6,257,539 B1 * 7/2001 Pelaez ..... B43K 23/002 206/214
6,533,133 B2 * 3/2003 Liu ..... B01L 9/06 211/74
6,640,981 B2 11/2003 Lafond et al.
7,066,329 B2 * 6/2006 Riley ..... A61C 3/04 206/369
7,132,082 B2 * 11/2006 Aviles ..... B01L 9/06 422/562
7,282,182 B2 10/2007 Dale et al.
7,383,846 B2 * 6/2008 Curran ..... A47L 15/502 134/135
7,820,115 B2 * 10/2010 Zatechka, Jr. ..... B01L 9/00 254/126
7,867,777 B2 * 1/2011 Aviles ..... G01N 35/025 422/509
7,910,067 B2 3/2011 Knight et al.
8,087,519 B2 * 1/2012 Bramley ..... A47L 15/505 211/41.3
8,142,740 B2 * 3/2012 Self ..... B01L 9/06 206/139
8,312,887 B2 * 11/2012 Dunn ..... A47L 15/505 134/135
D703,882 S * 4/2014 Williams ..... D32/3
8,911,233 B2 * 12/2014 Moore ..... A61C 3/04 211/70.6
8,940,252 B2 * 1/2015 Ziegler ..... B01L 9/06 422/562
9,956,684 B2 * 5/2018 Welfel ..... B25H 3/06
2002/0170867 A1 * 11/2002 Liu ..... B01L 9/06 211/74
2003/0017084 A1 1/2003 Dale et al.
2003/0034317 A1 2/2003 Lafond et al.
2003/0116463 A1 * 6/2003 Langtry ..... A47F 7/0028 206/443
2003/0211595 A1 11/2003 Lee
2005/0000554 A1 * 1/2005 Curran ..... A47L 15/502 134/135
2005/0161414 A1 7/2005 Wescott
2005/0236346 A1 * 10/2005 Whitney ..... B01L 9/06 211/74
2006/0065666 A1 * 3/2006 Dunn ..... A47L 15/505 220/676
2006/0266719 A1 11/2006 Knight et al.
2008/0206112 A1 * 8/2008 Fu ..... B01L 9/06 422/400
2010/0193453 A1 * 8/2010 Dunn ..... A47L 15/505 211/60.1
2010/0300997 A1 * 12/2010 Bramley ..... A47L 15/505 211/74
2014/0014605 A1 * 1/2014 Kilgore ..... A47L 15/501 211/85.25
2015/0048091 A1 * 2/2015 Chan ..... A47L 15/505 220/485
2015/0208899 A1 * 7/2015 Lee ..... A47L 15/502 134/201
2015/0209788 A1 * 7/2015 Dickinson ..... B01L 7/02 414/800
2019/0070573 A1 * 3/2019 Akiyama ..... B01L 9/06

* cited by examiner

FIG. 3A
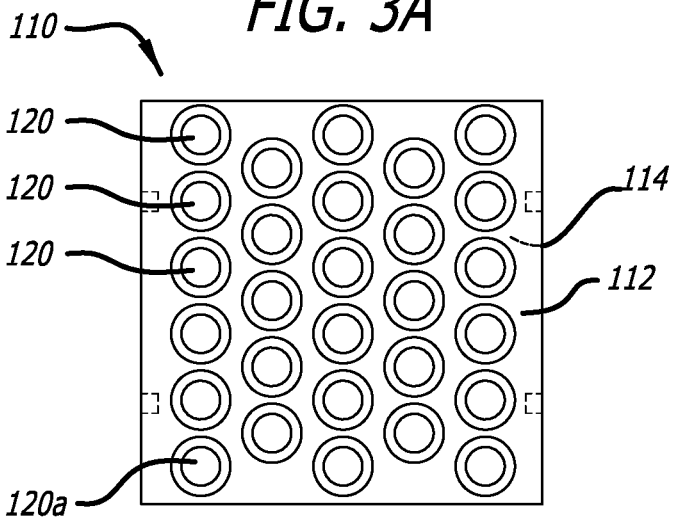
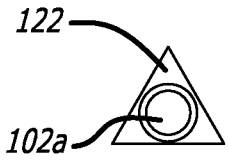
FIG. 3D
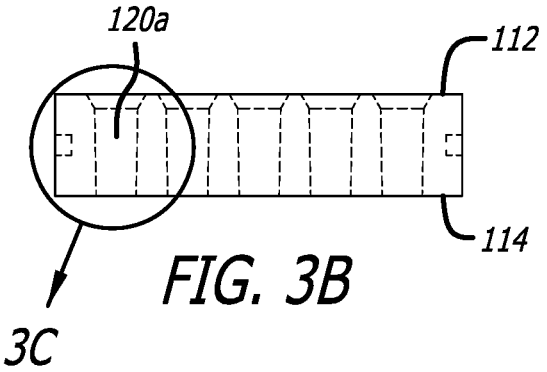
FIG. 3B
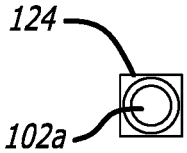
FIG. 3E
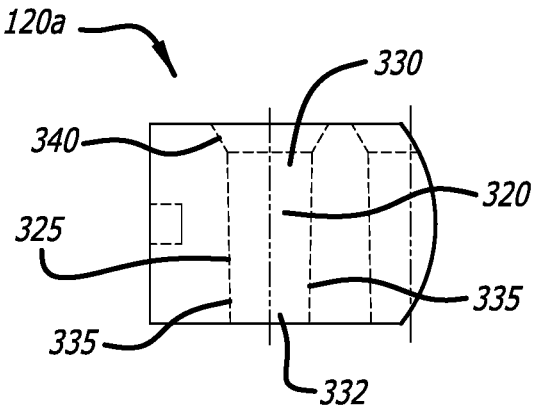
FIG. 3C
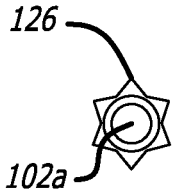
FIG. 3F

DRINKING STRAW CLEANING CADDY

FIELD

Embodiments of the disclosure relate to the field of cleaning equipment. More specifically, one embodiment of the invention relates to an apparatus and method for securely maintaining reusable items during a washing cycle within a cleaning appliance.

GENERAL BACKGROUND

In U.S.A. alone, 500 million straws are used every single day. Single-use straws have a very short lifespan before being discarded to landfill. Being made of plastic, these straws may take hundreds of years to break down. Further, disposable plastic drinking straws often contain levels of Bisphenol A (BPA) which complicates the recycling process. Accordingly, these aspects combine to create a huge environmental problem when it comes to disposing of these drinking straws.

To counteract this problem, some drinking straws have been developed using paper, bamboo, or similar biodegradable materials. Better still, reusable drinking straws have also been developed, negating any need for recycling. However, acceptance of reusable drinking straws by the public has been hindered by the lack of an effective means for thoroughly cleaning the reusable drinking straw both inside and out.

Currently, reusable drinking straws are placed alongside cutlery in various cleaning appliances (e.g., domestic and industrial cleaning dishwashers). These machines rarely orientate reusable drinking straws so that the inside of these straws are effectively cleaned. Rather, the reusable drinking straws and cutlery are placed into utensil holders or other containers, where the angular orientations of the straws are not consistently maintained in a manner that allows the flow of water and/or cleaning fluid to effectively wash and remove contaminants from the outer and inner surface of the straw. The inner surface of the straw surrounds the cylindrical conduit of the straw, referred to as a "lumen" of a straw.

What is needed therefore is an apparatus and method for allowing reusable drinking straws to be cleaned efficiently and easily, both inside and out. Such an apparatus and methods would promote customer confidence in reusable drinking straw cleanliness, which would promote popular acceptance of reusable drinking straws and dramatically reduce the volume of discarded disposable plastic straws.

BRIEF DESCRIPTION OF THE DRAWINGS

Embodiments of the disclosure are illustrated by way of example and not by way of limitation in the figures of the accompanying drawings, in which like references indicate similar elements and in which:

FIGS. 3A-F show various aspects of an embodiment of a guide plate for an exemplary drinking straw cleaning caddy in accordance with the present disclosure.

DETAILED DESCRIPTION

Various embodiments of the disclosure are directed to drinking straw cleaning apparatus (hereinafter, "cleaning caddy") and methods of use thereof. Various embodiments of the disclosure provide a drinking straw cleaning caddy that may be used in various commercial or domestic dishwashing machines. The caddy aligns each reusable straw, disposed therein, in a suitable orientation so as to enhance exposure of both the inner and outer surfaces of the straw to the flow of cleaning fluids. Further, the caddy may have minimal points of contact between each straw and the caddy while also preventing adjacent straws from contacting each other. Accordingly, this caddy promotes the flow of cleaning fluids across the straw leading to efficient cleaning thereof.

Terminology

In the following description, certain terminology is used to describe aspects of the invention. In other instances, specific numeric references such as "a first aperture," may be made. However, the specific numeric reference should not be interpreted as a literal sequential order but rather interpreted that the "first aperture" may be different than a "second aperture." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

It should also be understood that, unless indicated otherwise, any labels such as "left," "right," "front," "back," "top," "bottom," "top," "bottom," "forward," "reverse," "clockwise," "counter clockwise," "up," "down," or other similar terms such as "upper," "lower," "aft," "fore," "vertical," "horizontal," "proximal," "distal," and the like are used for convenience and are not intended to imply, for example, any particular fixed location, orientation, or direction. Instead, such labels are used to reflect, for example, relative location, orientation, or directions. Lastly, in certain situations the terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Drinking Straw Cleaning Caddy

Figure 1:
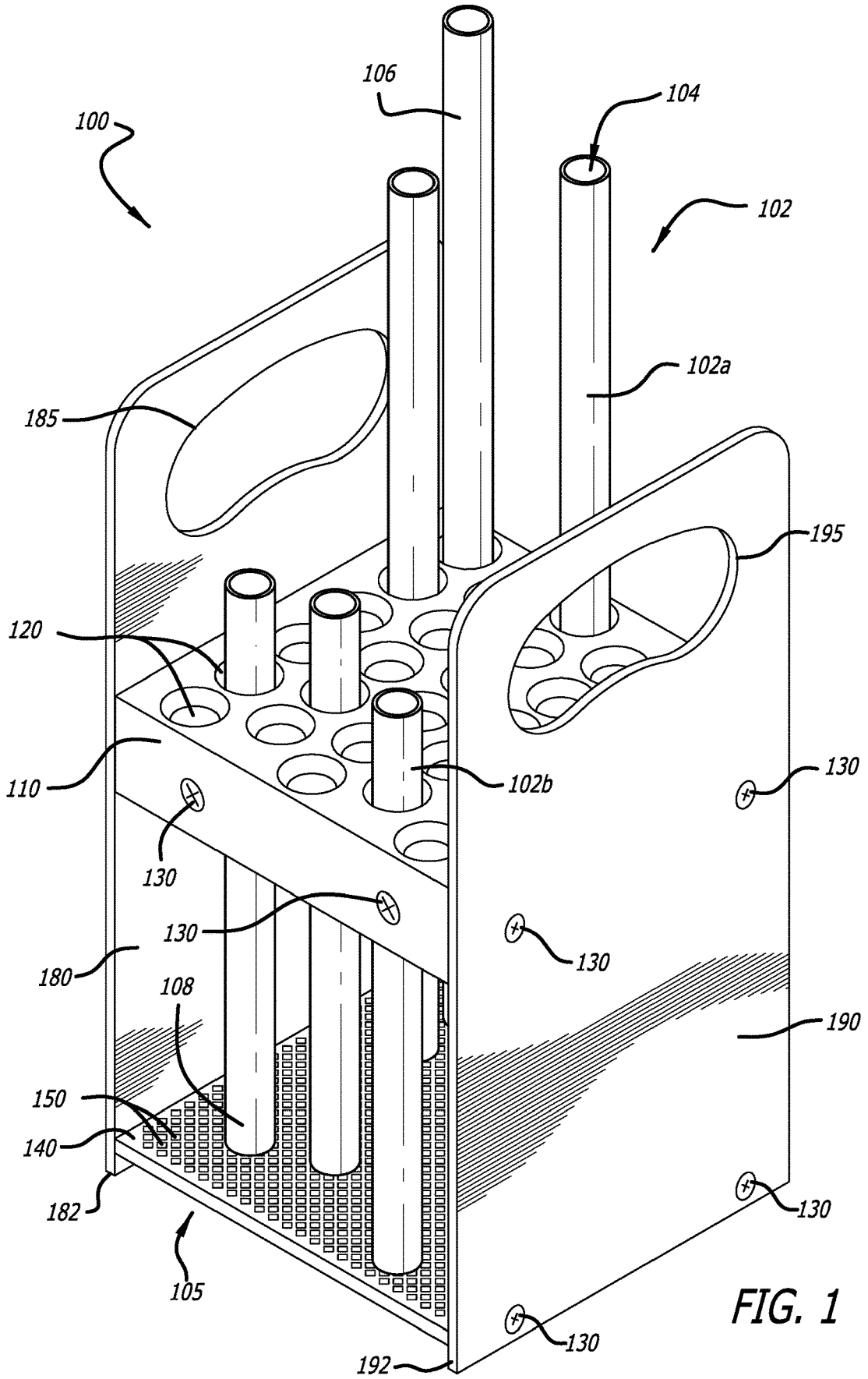
FIG. 1 is an exemplary apparatus of a drinking straw cleaning caddy including a guide plate, a base plate, and one or more side pieces.

Referring to FIG. 1, a perspective view of a first exemplary embodiment of a cleaning caddy 100 is shown. The caddy 100 includes a guide plate 110, a base plate 140, and one or more side panels (e.g., a pair of side panels 180, 190). Herein, the caddy 100 is described for retention of reusable drinking straws 102 which may be made of a rigid material such as glass, hardened plastic, or the like. Of course, in lieu of reusable drinking straws 102, the caddy 100 may be configured to receive other types of reusable items made of rigid material such as mixing rods, swizzle sticks, or the like.

The guide plate 110 may include a first plurality of apertures 120. Each aperture 120 may be sized to receive one of the reusable drinking straws 102. It will be appreciated that reusable drinking straws 102 may be provided in different sizes (e.g., lengths, diameters, etc.), and/or different materials. For instance, one reusable drinking straw 102*a* is illustrated as having a different (e.g., longer) length and/or different (e.g., greater) diameter than another reusable drinking straw 102*b*. Accordingly, the caddy 100 may be configured to accommodate a single straw diameter (with different caddies for different straw diameters) or may be configured to accommodate different straw diameters, as discussed herein. As used herein, each of the reusable drinking straws 102 may have an upper end 106 and a lower end 108. A lumen 104 may extend through a central axis of the straw fluidly connecting the upper end 106 with the lower end 108 such that the straw has an inner surface and an outer surface. As previously noted, it should be understood that "upper," "lower," "inner," and "outer," are used for convenience to reflect relative location, orientation, or directions.

Each of the first plurality of apertures 120 may be designed to maintain one of the reusable drinking straws 102 in an orientation that is substantially parallel to the flow of cleaning fluids. As used herein, the term "cleaning fluids" may include, water, detergents, soaps, solvents, or any substance or combination of substances known in the art suitable for cleaning reusable items such as drinking straws 102. While cleaning fluids may typically flow along a substantially vertical axis, it will be appreciated that the flow of cleaning fluids may also occur along a horizontal axis, or at an angle. As used herein, the flow of cleaning fluids is considered to flow along a substantially vertical axis and each of the reusable drinking straws 102 is angularly retained relative to this vertical axis (e.g., within five degrees (5°) from vertical).

The base plate 140 may also include a second plurality of apertures 150, which may be shaped differently from the first plurality of apertures 120 in order to support the reusable drinking straws 102 while allowing cleaning fluids to drain from inside of the reusable drinking straws 102, and/or cleaning fluids to enter the inside of the reusable drinking straws 102 from beneath the base plate 140. The base plate 140 also prevents the reusable drinking straws 102 from extending beyond a lower perimeter 105 of the caddy 100. The base plate 140 may also maintain the reusable drinking straws 102 in an elevated position, relative to both edges 182 and 192 of the side panels 180 and 190, respectively. This elevated position advantageously allows the cleaning fluids to drain away from the reusable drinking straws 102.

The side panels 180 and 190 maintain the guide plate 110 and base plate 140 in a spaced apart configuration. The side panels 180 and 190 may also maintain the base plate 140 in the elevated position, as described above, further allowing for cleaning fluids to drain away from the base plate 140 and the reusable drinking straws 102 supported by the base plate 140. The side panels 180 and 190 may also extend beyond an upper surface of the guide plate 110. At least one of the side panels 180 or 190 may include a handle 185 or 195, respectively. As shown, both side panels 180 and 190 include handles 185 and 195, or similar structures, with which a user may grasp the caddy 100.

Figure 2:
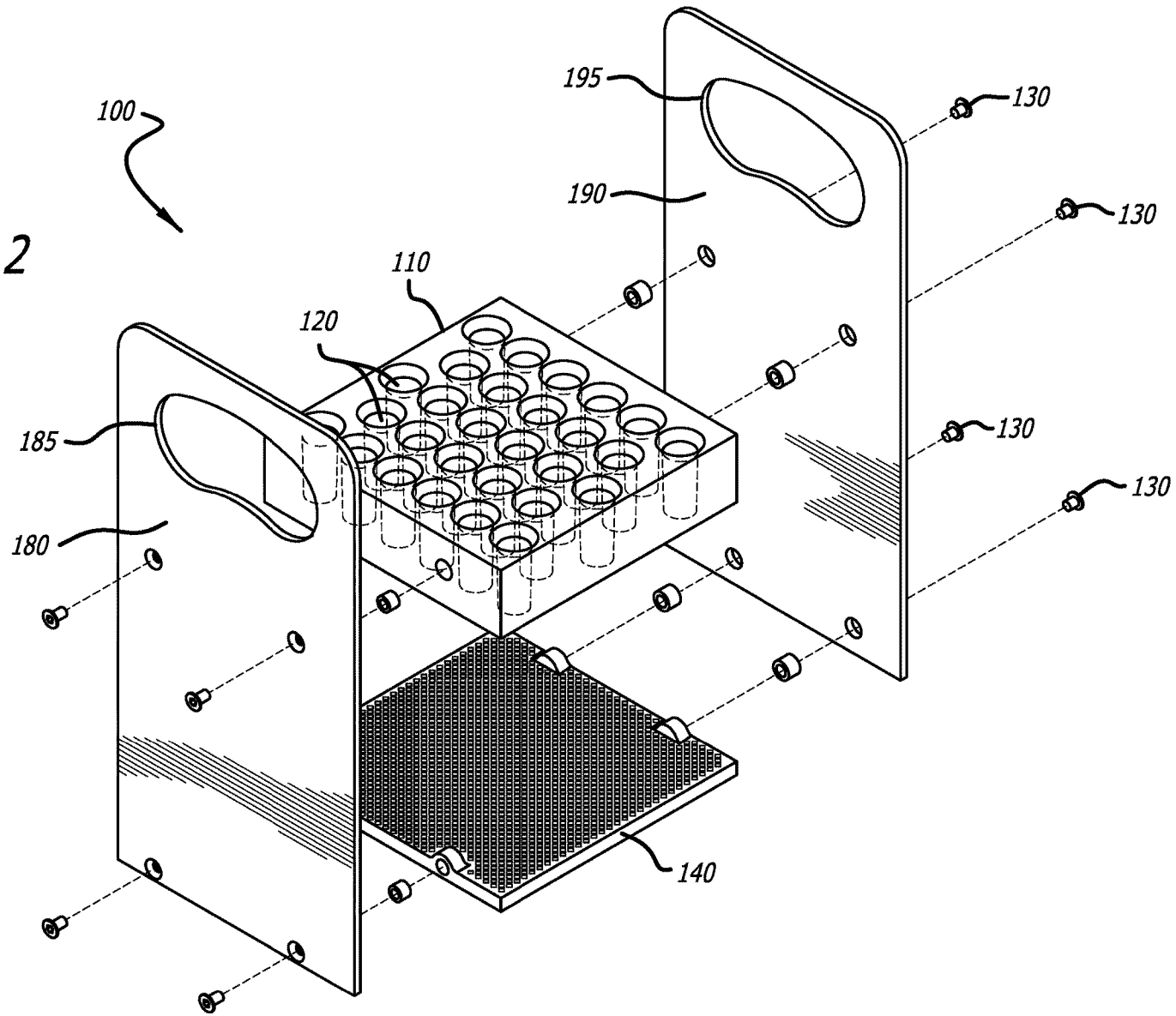
FIG. 2 is an exploded view of an exemplary apparatus for a drinking straw cleaning caddy in accordance with the present disclosure.

As shown in FIG. 2, an exploded view of the first exemplary embodiment of the caddy 100 is shown. Herein, various components of the caddy 100, including the guide plate 110, base plate 140, and side panels 180 and/or 190 may be held together using one or more fasteners 130. The fasteners 130 may include brass screws, however, screws, nails, rivets, bolts, dowels, clips, tabs, slots, or other fastening structures made of similar suitable materials, known in the art are contemplated to fall within the scope of the invention. Alternatively, it is also contemplated that the various components of the caddy 100, including the guide plate 110, the base plate 140, the side panels 180 and 190 may be held together using any suitable adhesive, welding, or similar attachment method known in the art. As yet another embodiment, it is contemplated that the caddy 100 may be formed as a monolithic structure.

Referring now to FIGS. 3A-F, a plan view, side view and close up details of an embodiment of the guide plate 110 are shown. As shown in FIG. 3A, when viewed from a plan view orientation, the guide plate 110 may include a substantially square or rectangular outer perimeter. However, it will be appreciated that any triangular, hexagonal, circular, or any closed curve polygonal shape also falls within the scope of the present invention.

The guide plate 110 may include one or more apertures 120. As illustrated in FIG. 3A, the apertures 120 may be arranged in a triangular, or 'honey comb,' orientation. However, square, elongated triangular, snub square, or other configurations of arranging, or 'circle packing,' the apertures 120 are contemplated to fall within the scope of the present invention. Each aperture 120 may be sized to receive a reusable drinking straw (not shown) and are spaced in such a way so as to prevent straws, disposed in adjacent apertures, from coming into contact with one another in both before, during and after a washing process. This may be achieved by the distance between the apertures 120, the arrangement of apertures 120 disposed in the guide plate 110, the depth of the guide plate 110, the length of the lumen of the aperture (hereinafter, "aperture lumen 320"), or combinations thereof. According to one embodiment of the disclosure, the depth of the guide plate 110, namely a distance between a top surface 112 and a bottom surface 114 of the guide plate 110, may range from approximately 15 mm (e.g., 0.59 in.) to approximately 30 mm (e.g., 1.18 in.) with a preferred embodiment being approximately 25.4 mm (e.g., 1 inch). Such a depth, in combination with the size of apertures 120, relative to the size of the reusable drinking straws 102 may limit any horizontal movement of the straws 102 thus both maintaining the straw in a substantially vertical orientation and preventing adjacent reusable drinking straws 102 from making contact with one another.

Each of the apertures 120 may be configured with a minimum lumen diameter that exceeds an outer diameter of a reusable straw. In an embodiment of the disclosure, each aperture 120 may have a minimum lumen diameter ranging from approximately 0.1 mm (e.g., 0.004 in.) to approximately 1.0 mm (e.g., 0.04 in.) greater than the outer diameter of a reusable straw, with a preferred embodiment having a minimum lumen diameter of approximately 0.5 mm (e.g., 0.02 in.) greater than the outer diameter of a reusable straw. It will be appreciated that apertures 120 may be of a similar size, or may be of different sizes to accommodate different sizes of reusable drinking straws 102.

Although each of apertures 120 shown in FIG. 3A are substantially circular, it is contemplated that other closed curve shapes may be used. As best seen in FIGS. 3D-3F, by way of illustrative examples, each of apertures 120 may be triangular 122, square 124, star-shaped 126, 'clover-leaf' shaped (not shown), or similar regular or irregular, closed-curve, cross-sectional shape configured such that a minimum circular diameter within the cross-sectional shape is slightly larger than the outer diameter of the reusable drinking straw. Such cross-sectional shapes may be advantageous since the total outer surface area of the reusable drinking straw 102*a* that contacts the caddy 100 is kept to minimum, thus providing improved access for cleaning fluids.

It is contemplated that, while most reusable drinking straws are substantially straight with a uniform outer diameter, some drinking straws have varying outer diameters and/or have non-linear configurations. However, it will be appreciated that the minimum lumen diameter of the apertures 120 will be of an appropriate dimension to receive at least a lower portion of the drinking straw there through, such that the straw will maintain a substantially vertical orientation.

Referring now to FIGS. 3B-C a side view of the guide plate and close up detail of an aperture 120 are shown. An aperture lumen 320 may include a slightly tapering shape 325 such that a diameter of an upper portion 330 of the aperture lumen 320 may be larger than a diameter of a lower portion 332. Stated differently, the diameter of a first end 330 of the aperture lumen 320 is larger than a diameter of a second end 332 of the aperture lumen 320. In an embodiment the angle of tapering from a vertical axis may range from approximately 0.1° to approximately 10°, with a preferred embodiment having an angle of tapering from a vertical axis of 2°. Accordingly, a minimum lumen diameter may be located at a lower end of the aperture 120.

As alternative embodiments, the minimum lumen diameter may be located at an upper end of the aperture lumen 320 such that the lumen may have an inverse tapering shape from that shown in FIG. 3C. In another embodiment, the minimum lumen diameter may be located at a mid-point of the aperture lumen 320 such that the apex of the tapering is located at a mid-point along the aperture lumen 320 thus giving a double cone or angular 'hour glass' shape to a side view profile of the aperture lumen 320. These various tapering shapes may be advantageous when the direction of flow for the cleaning fluids may originate from either the top side of the device, the bottom side of the device, or a combination thereof.

As will be appreciated the tapering structure of one or more of the first plurality of apertures 120 (hereinafter, aperture 120*a*) may advantageously funnel cleaning fluids in between an outer surface of the straw and an inner surface 335 of the aperture 120. Further, the tapering shape may also reduce the contact surface area between the aperture 120*a* and a reusable drinking straw. Accordingly the straw may contact the aperture lumen 320 only at positions where the diameter of the aperture lumen 320 is at a minimum, as opposed to the entire length of the aperture lumen 320. In an embodiment, and although not shown in the drawings, the side walls of the aperture lumen 320 may include a convex profile, such that the aperture lumen 320 adopts a slight hyperboloid, or a smooth 'hour glass' shape. Accordingly, should the angle of the straw move with respect to the vertical axis, the point of contact between the substantially linear straw and the convex wall of the aperture lumen 320 may be kept to a minimum.

As best seen in FIG. 3C, one or more of the first plurality of apertures 120 (e.g., aperture 120*a*) may further include a tapered entrance 340, located on a upper surface of the guide plate 110, of a less acute angle of tapering than the tapering of the aperture lumen 320. In an embodiment, the amount of tapering at the tapered entrance 340 may exceed 30° with a preferred embodiment being 60°. The tapered entrance 340 may facilitate guiding a straw into the aperture lumen 320 when the straw is being loaded into the caddy 100. Further, the tapered entrance 340 may capture additional cleaning fluids and direct them into the aperture lumen 320 along an outer surface of the straw, rather than letting the fluids fall off a side of the guide plate 120.

Figure 4A:
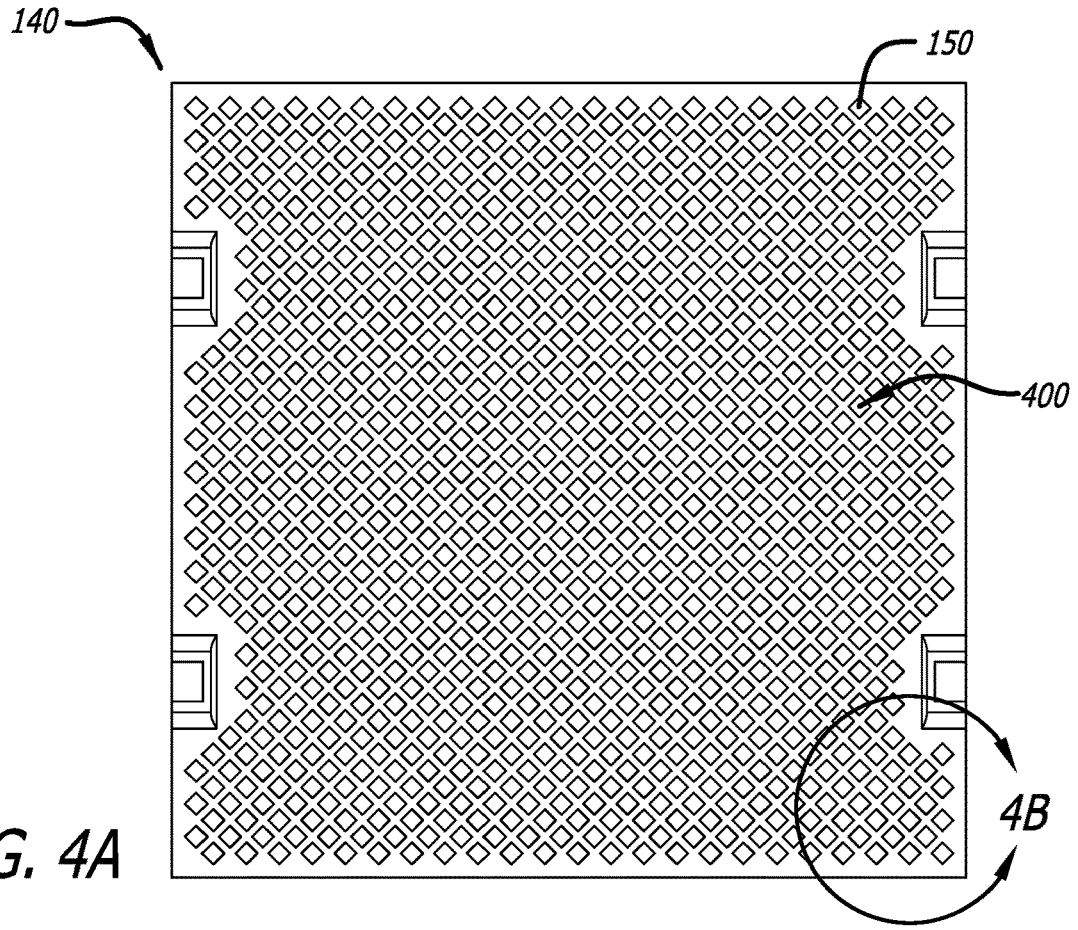
FIGS. 4A-H show various aspects of an embodiment of a base plate for an exemplary drinking straw cleaning caddy in accordance with the present disclosure.
Figure 4B:
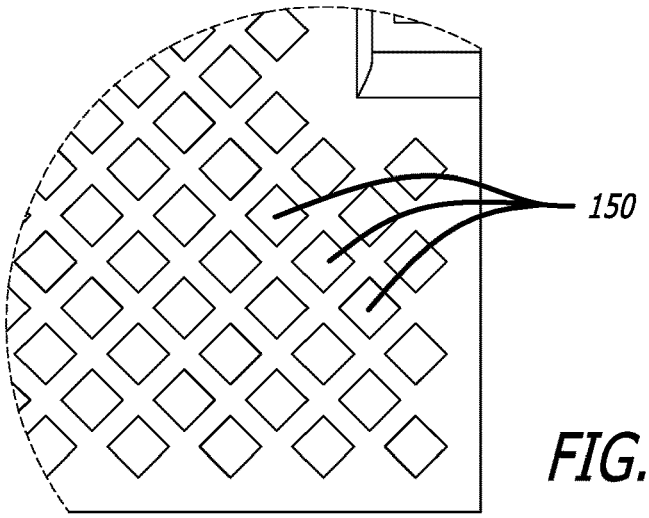

Referring to FIGS. 4A-H, plan views, and close up detail of an embodiment of the base plate 140 are shown. As shown in FIG. 4A, the base plate 140 may feature a mesh structure 400 including the second plurality of apertures 150. Each of the apertures of the second plurality of apertures 150 may include a maximum lumen diameter that is less than the outer diameter of a reusable drinking straw 102*a*. In an embodiment, the second plurality of apertures 150 may include a plurality of square apertures arranged in a square pattern. In an embodiment the apertures 150 may have a maximum width ranging from approximately 1 mm (e.g., 0.04 in.) to approximately 6 mm (e.g., 0.24 in.), with a preferred embodiment having a maximum width of approximately 2 mm (e.g., 0.08 in.). In an embodiment, the distance between the apertures 150 is between approximately 0.5 mm (e.g., 0.02 in.) and 2 mm (e.g., 0.08 in.), with a preferred embodiment having a distance between the apertures 150 of approximately 1 mm (e.g., 0.04 in.)

It is contemplated that apertures 150 may include other cross-sectional shapes and arrangements which fall within the scope of the present invention. By way of an illustrative example, apertures 150 may be substantially triangular, square, star-shaped, 'clover-leaf' shaped, or similar regular or irregular, closed-curve, cross-sectional shape designed such that a minimum circular diameter within the cross-sectional shape may be smaller than the outer diameters the reusable drinking straws 120. By way of an illustrative example, apertures 150 may be arranged in a triangular, honey-comb, or other arrangement of 'circle packing,' as discussed herein. In an embodiment the base plate 140 is configured to capture a lower end 108 of a reusable drinking straw 102*a* and to stop the straws from sliding further through apertures 120 of the guide plate 110. In an embodiment the apertures 150 may be configured to allow the cleaning fluids to drain through. In an embodiment the apertures 150 may be configured to allow cleaning fluids to flow upwards therethrough.

Figure 4C:
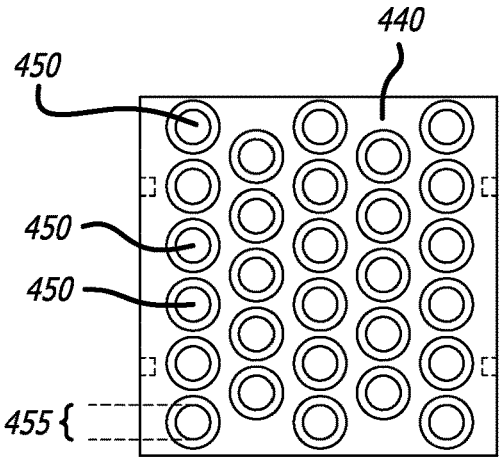

As an alternative embodiment, as shown in FIG. 4C, a base plate 440 may include apertures 450 configured to align with the apertures 120 of the guide plate 110. As discussed herein, each of the apertures 450 feature a maximum aperture lumen diameter 455 that is less than the outer diameter of a reusable drinking straw. By way of an illustrative example, where the drinking straws 102 may have an outer diameter of 9.5 mm (e.g., 0.37 in.), the lumens of the apertures 450 may have a maximum lumen diameter no more than 9 mm (e.g., 0.35 in.), with a preferred embodiment having a maximum lumen diameter of 8.5 mm (e.g., 0.33 in.). It is contemplated that the relative differences between the outer diameters of the straws 102 and the diameters of the apertures 120, 150, 450 may vary proportionately, either by a similar ratio, or by a similar difference in absolute measurements. It will also be appreciated that individual apertures 120, 150, 450 within a given guide plate 110 or base plate 140, 440, may be of varying sizes so as to accommodate different sized straws 102 within the caddy 100, without departing from the spirit of the invention.

In an embodiment, one or more of the apertures within a base plate 140, 440 (e.g., one or more apertures 150 or one or more apertures 450) may include a tapered lumen. In an embodiment the angle of tapering from a vertical axis may be between 0.1° and 10° with a preferred embodiment having an angle of tapering from a vertical axis of 2°. The tapering may be orientated to reduce towards a top surface (e.g. FIG. 4G), a bottom surface (e.g. FIG. 4D), or a combination thereof to create an 'hour glass' shape (e.g. FIG. 4H), as discussed herein. Such tapering may advantageously capture cleaning fluids and direct them away from the drinking straw. Further, such tapering may capture cleaning fluids directed upwards and channel these fluids into the lumen 104 of the drinking straw.

Figure 4D:
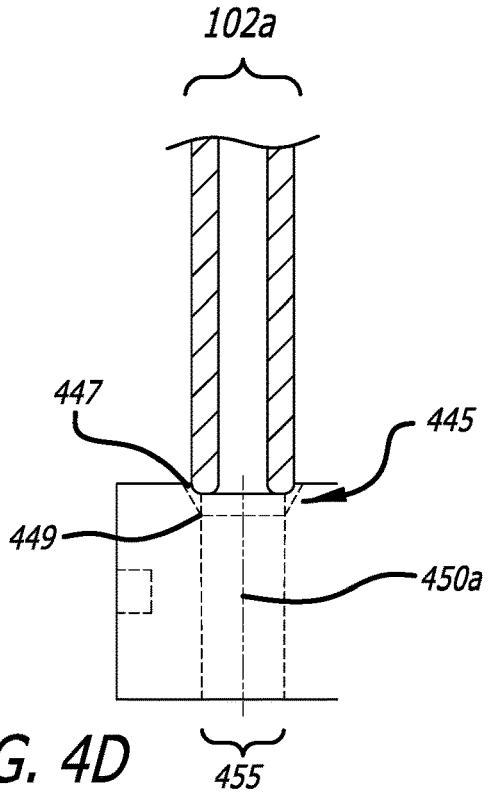

For instance, as shown in FIG. 4D, aperture 450*a* may further include a tapered entrance 445 on an upper surface of the base plate 440, similar to that discussed herein in relation to tapered entrance 340 of the aperture 120*a* as shown in FIG. 3C. For this embodiment, the tapered entrance 445 may exceed a 30° angle, with a preferred tapering of approximately 60°. The tapered entrance 445 for the aperture 450*a* may be configured with an upper diameter 447 larger than an outer diameter of a straw 102*a*, while a lower diameter 449 of the tapered entrance 445 may be smaller than the outer diameter of straw 102*a*. Accordingly, the tapered entrance 445 may capture a lower end of a straw 102*a* such that it seats over aperture 450*a*.

Figure 4E:
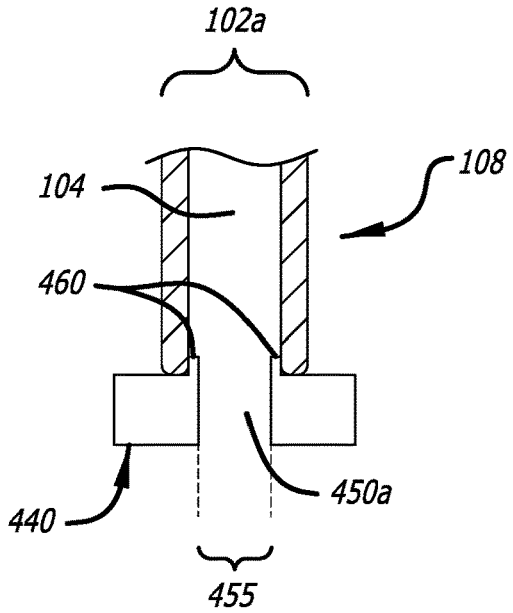
Figure 4F:
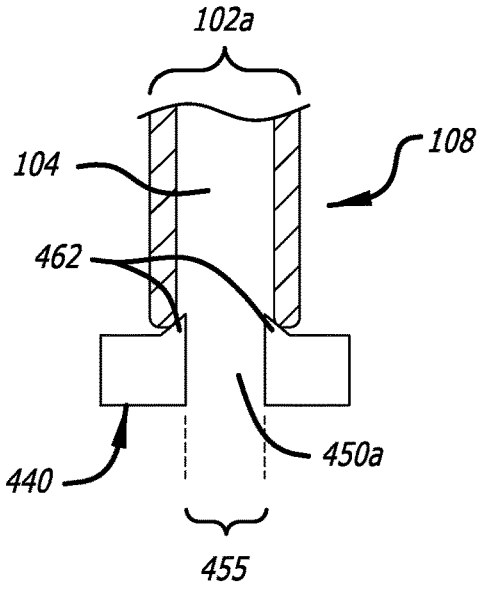
Figure 4G:
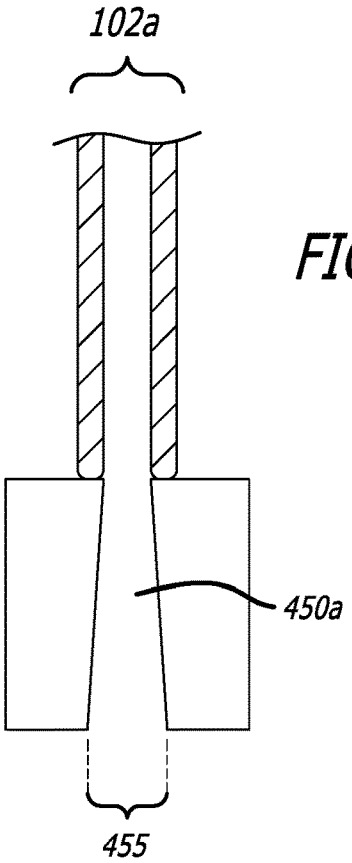
Figure 4H:
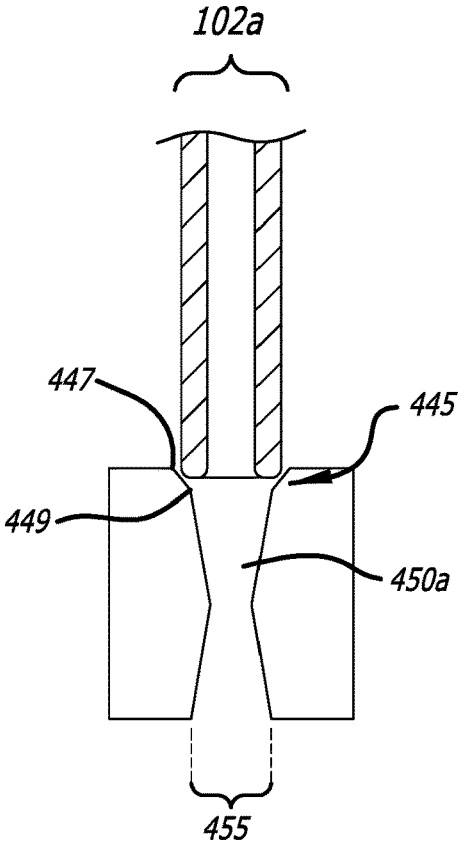

Referring now to FIGS. 4E-4F, aperture 450*a* may include a ridge 460 along a periphery of the entrance of the aperture 450*a*. Ridge 460 may be configured such that and upper edge of the ridge 460 has a diameter that is less than an inner diameter of a straw lumen 104 such that the ridge 460 fits within a lower entrance of the straw 102*a*. As shown in FIG. 4E, outer walls of the ridge 460 may align with a lower end of the straw such that the straw slots over the ridge 460 and the straw lumen 104 aligns with the aperture 450*a*. In an alternate embodiment, as shown in FIG. 4F, the outer walls of a ridge may be angled 462 such that the entrance of aperture 450*a* substantially has a truncated cone shape with aperture 450 through a vertical axis. Stated differently, the entrance of aperture 450*a* of FIG. 4F is substantially an inverse of the tapered entrance 455 of FIG. 4D. Accordingly, the central axis of the straw 102*a* aligns with a central axis of the aperture 450*a*. Advantageously, such a design may accommodate varying diameters of straw lumens while maintaining a central axis of the straw with a central axis of the aperture 450*a*. Although ridges 460, 462 are shown with angular edges, it will be appreciated that such structures may be formed with rounded edges. This may advantageously prevent crevices forming at the apices between the surfaces, which may collect dirt and grim leading to unhygienic conditions. Further, such rounded structures may reduce the contact surface area between the caddy 100 and the straws 102 improving exposure to the cleaning fluids, as discussed herein.

As will be appreciated, ridges 460, 462 may work in conjunction with the guide plate 110 to maintain the straws 102 in a substantially vertical orientation. As discussed herein such an orientation prevents adjacent straws from making contact and increasing the surface area exposed to the cleaning fluids. Further, such an orientation maintains the axes of the straws 102 substantially parallel with the flow of cleaning fluids, promoting efficient cleaning of the inner surfaces of the straw.

Figure 5:
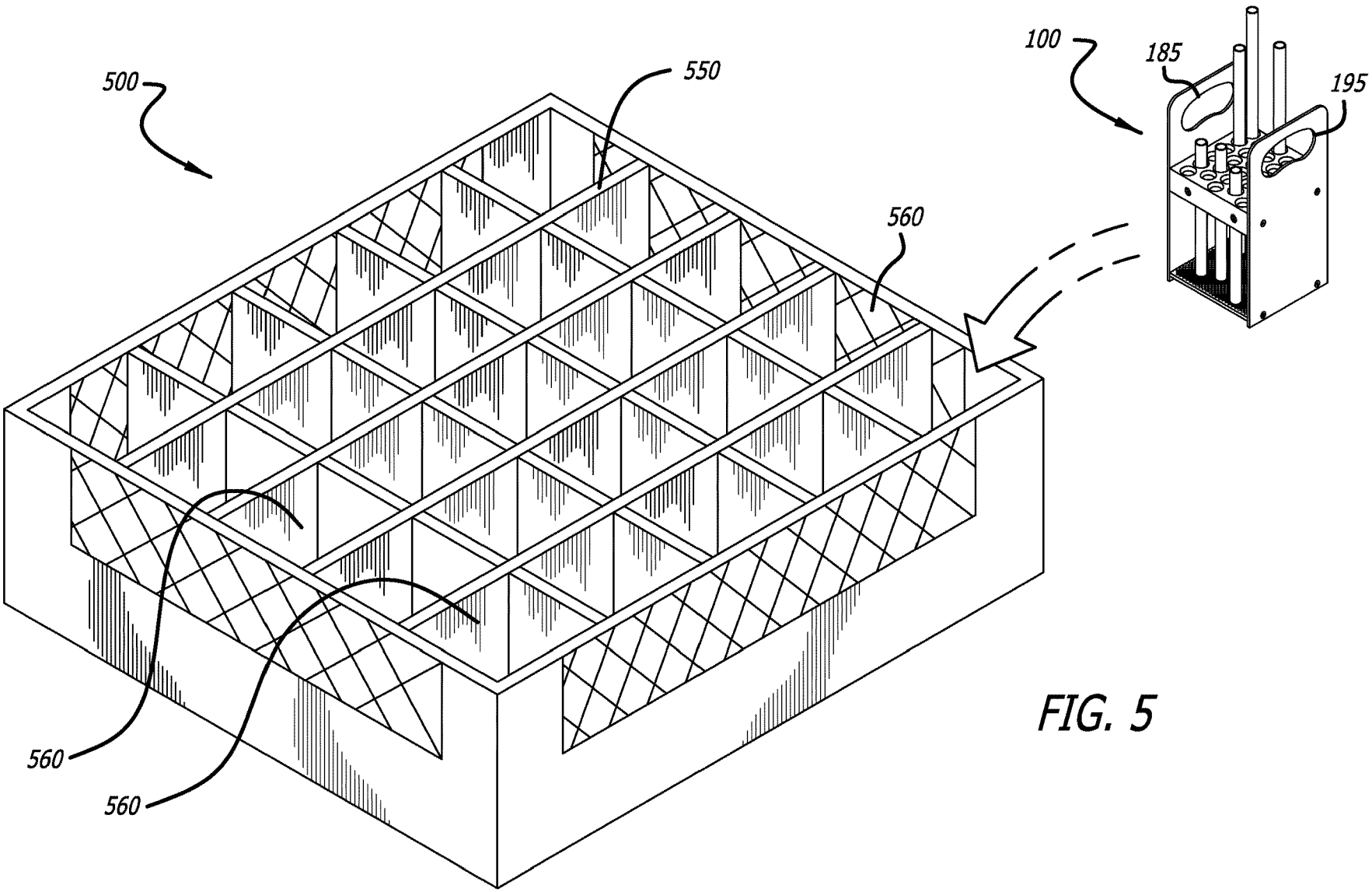
FIGS. 5-6 are exemplary apparatus and methods of use for a drinking straw cleaning caddy.
Figure 6:
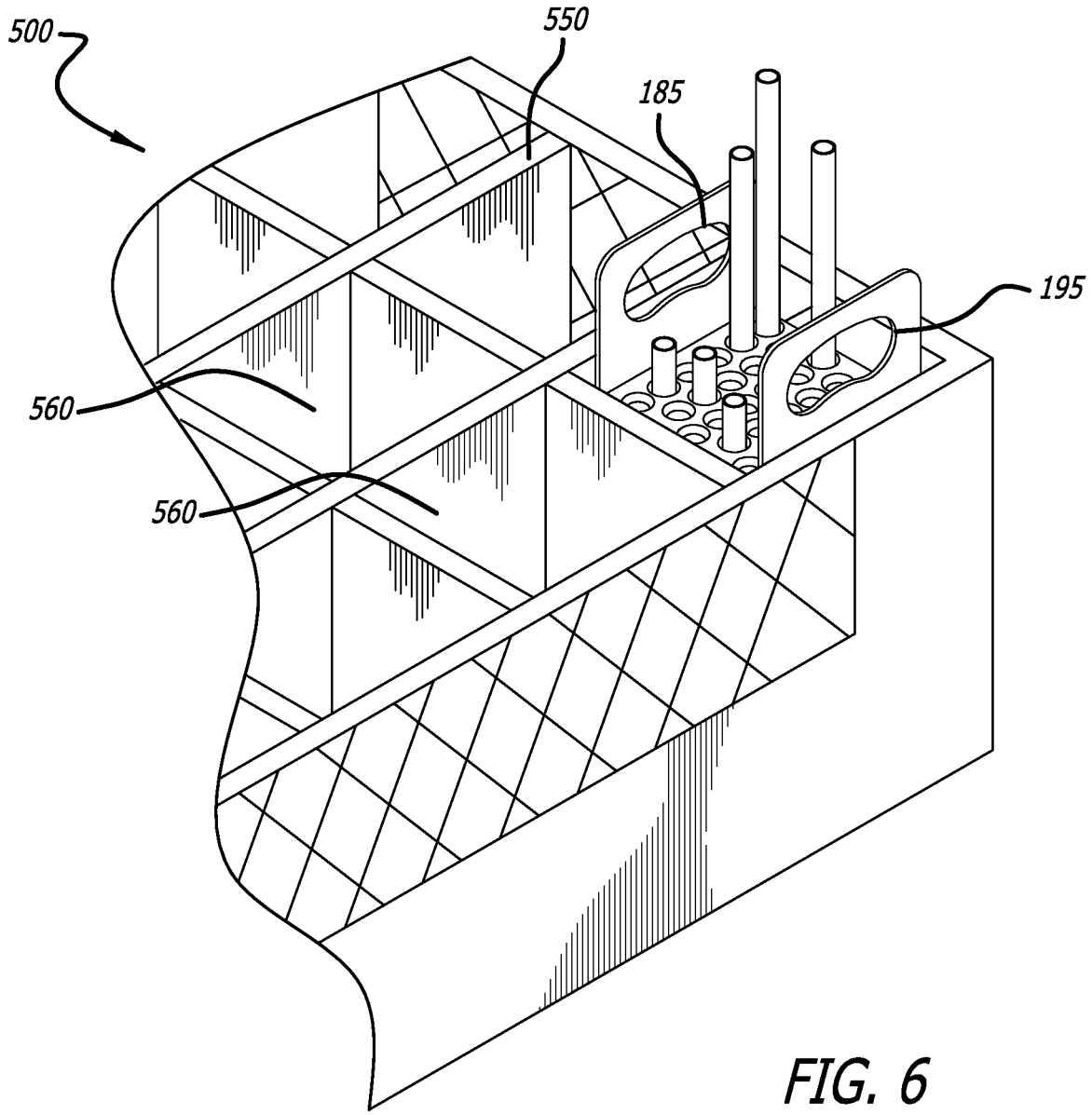

As shown in FIGS. 5-6, caddy 100 may be sized to fit within a commercial or domestic washing tray 500. Tray 500 may include dividers 550 used to separate certain sized dishware. For example, tray 500 may include dividers 550 to create compartments 560 which may house individual glasses or similar items, as is known in the art. In an embodiment, caddy 100 may be designed to fit within one of these compartments 560 and maintain a substantially upright position. Further, certain trays (not shown) may include posts such as those used to hold various sizes of plates or dishes. Caddy 100 may also be configured to fit between these posts.

In an embodiment, caddy 100 may include one or more handles 185 and/or 195, or similar structures, with which a user may grasp the caddy 100. As shown in FIG. 6, the handles 185 and/or 195 may allow a user to retrieve the caddy 100 from compartment 560 or from between posts (not shown) after a washing process has been completed, while advantageously avoiding touching any of the clean straws 102. In an embodiment, caddy 100 includes handles 185 and 195 which are part of side panels 180 and 190 respectively, although other combinations of handles 185 and 195 are contemplated to fall within the scope of the present invention. In an embodiment, the caddy 100, with drinking straws 102 disposed therein in, may be below an upper perimeter of the tray 500 when disposed within a compartment 560. Accordingly, additional trays or items may be stacked on top of tray 500 while a caddy 100 is positioned within compartment 560.

Figure 7:
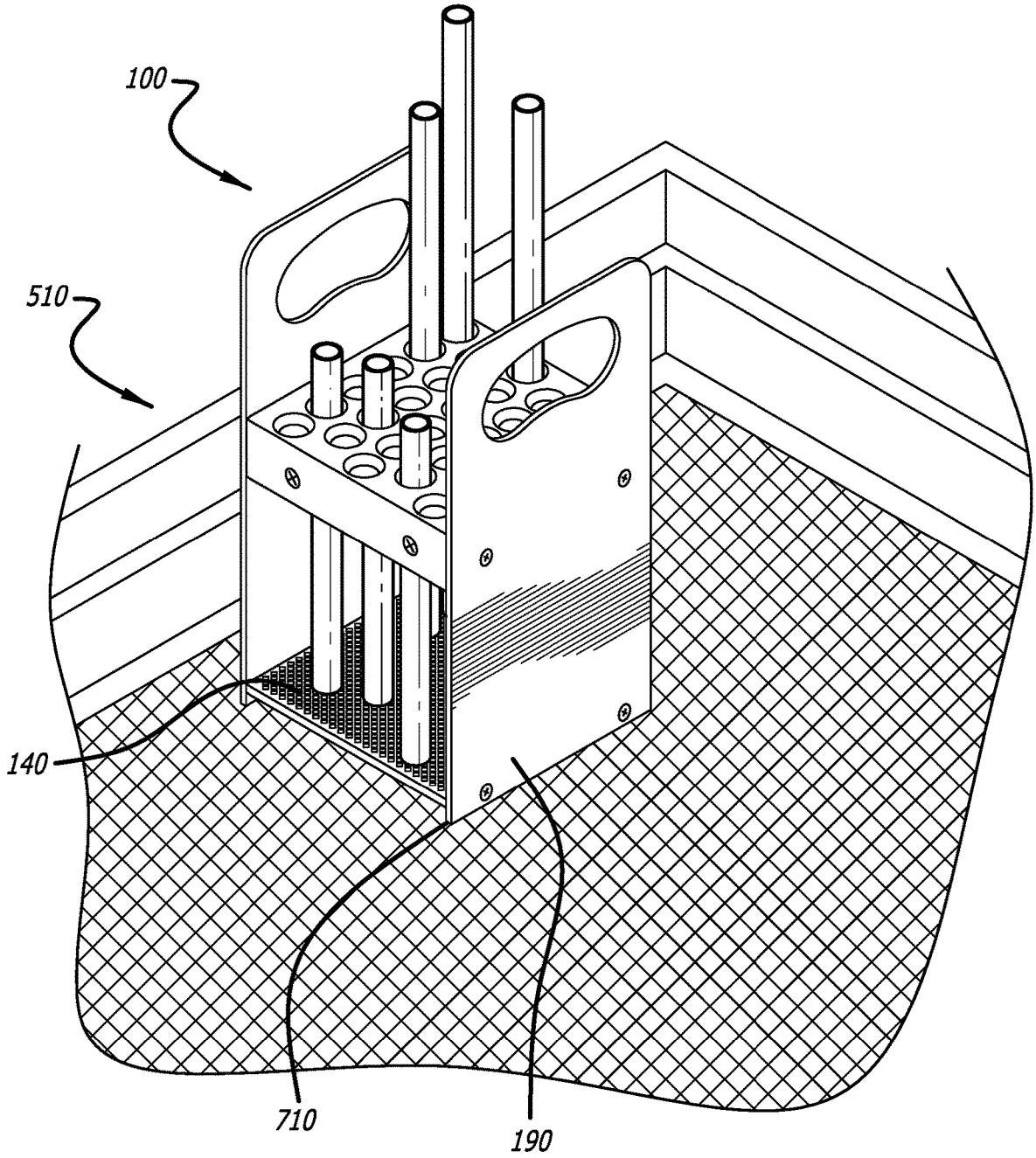
FIG. 7 is an exemplary apparatus and method of use for a drinking straw cleaning caddy.

In an embodiment, and as best seen in FIG. 7, caddy 100 may also be used with trays 510 that do not have any dividers or posts. As such, caddy 100 may be configured to maintain an upright position without any support from dividers or posts. In an embodiment, caddy 100 may include protrusions 710 (e.g., edges 182 and 192 of FIG. 1). These protrusions 710 may be configured to maintain a lower surface of the base plate 140, 440 in an elevated position, separated from a surface of the tray 500, 510. These protrusions may extend from the side panels 180 and 190, from the base plate 140, 440, or combinations thereof. These protrusions may advantageously allow cleaning fluids to drain away from straws 102, and base plate 140, 440 and prevent these fluids from becoming trapped between base plate 140, 440 and the tray 500, 510 which would otherwise create unhygienic conditions. Although not shown, it is contemplated that protrusions 710 may further include posts, clips, feet or similar structures that protrude downwards between the mesh of the tray surface. Such structures may advantageously further stabilize the caddy 100 during use, especially when being used with trays 510 that lack dividers 550 or posts.

Figure 8:
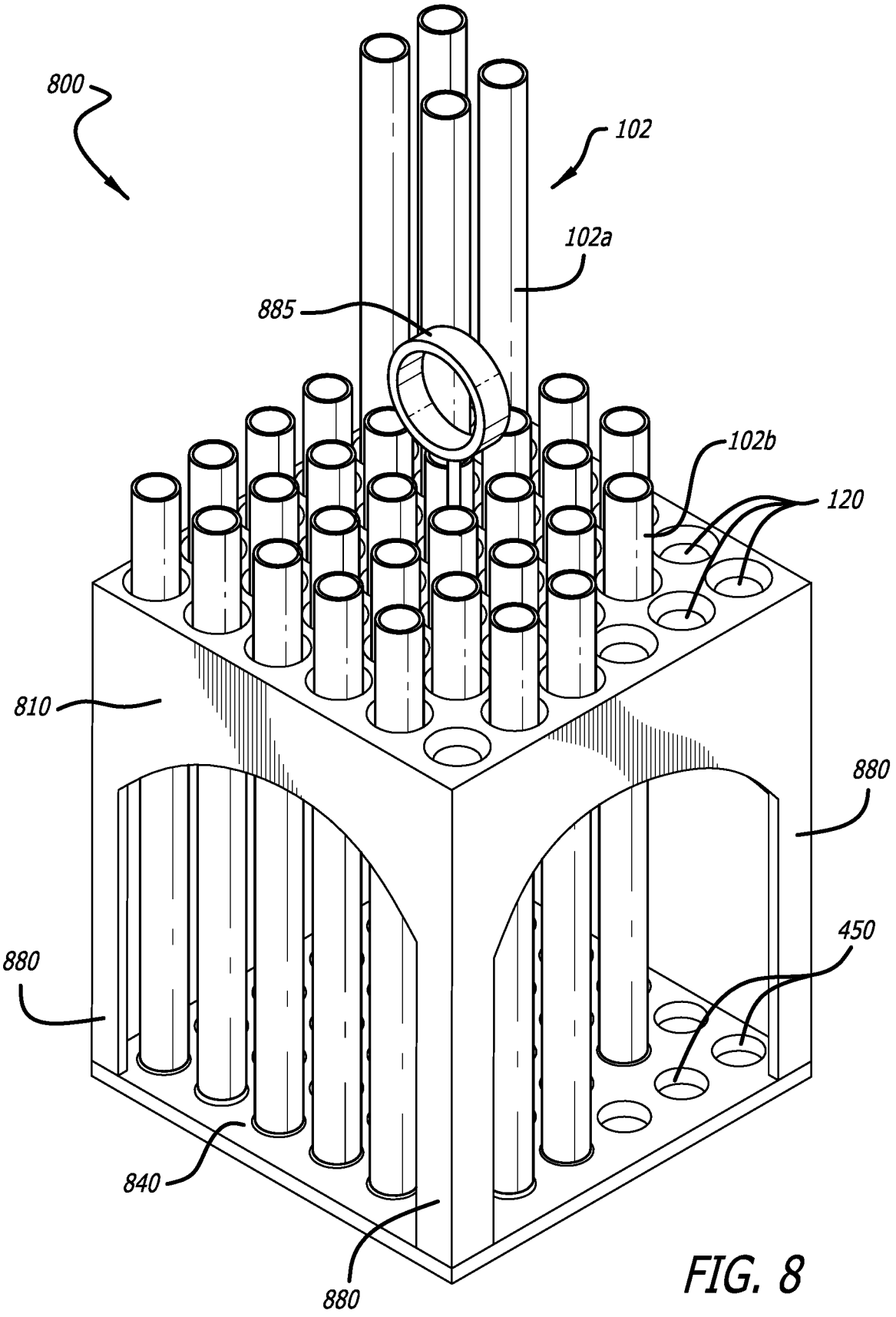
FIG. 8 is an exemplary apparatus of a drinking straw cleaning caddy in accordance with embodiments disclosed herein.

According to another embodiment of the disclosure, and shown in FIG. 8, a caddy 800 may be formed of a single monolithic piece by injection molding or any suitable manufacturing process known in the art. The caddy 800 may include legs 880 to maintain a spaced apart relationship between a guide plate 810 and base plate 840. The base plate 840 may include apertures 450 that may substantially align with apertures 120 to maintain the straws 102 in a substantially vertical orientation, as described above. The caddy 800 may include one or more handles 885, such handles may include a centrally placed finger loop. The handle 885 may be integrally formed and coupled to the guide plate 810 of the caddy 800 or may be a separate structure coupled with the caddy 800 through one of apertures 120, or through a dedicated attachment structure. As discussed herein, the handle 885 may extend from an upper surface of the caddy 800 such that a user may grasp the handle and raise/lower the caddy 800 without having to touch any of the straws 102.

In an embodiment, it is contemplated that one or more portions of the caddy 100, 800 may include different materials displaying differing characteristics. By way of an illustrative example, the guide plate 110 may include a substantially rigid polymer while apertures 120 may include a silicone rubber tapered tube disposed therein. Such silicone rubber tubes may advantageously hold the reusable straws 102 more securely and/or adapt to various, non-linear straws, disposed therein. Other materials that display suitable mechanical and chemical properties, known in the art, are contemplated to fall within the scope of the present invention.

In an exemplary method of use a drinking straw cleaning caddy 100 or 800 may receive one or more reusable drinking straws 102. A user may slot one or more straws 102 into the one or more apertures 120 of the caddy 100 or 800. Each of the one or more straws 102 may pass through the one or more apertures 120 until a lower end 108 of the straw may contact the base plate 140 or 440. Base plate 140 or 440 may be configured to prevent further downward movement of the straws 102. The caddy 100 or 800 may then be placed in a tray 500, 510 (see FIGS. 5-7) or similar structure used to pass through a commercial or domestic dishwashing machine. According to one embodiment, the caddy 100 or 800 may be placed into the tray before the straws 102 are loaded into the caddy 100 or 800. Alternatively, the caddy 100 or 800 may be placed into the tray after the straws 102 are loaded into the caddy 100 or 800. During the washing process, the apertures 120, 150, 450 are configured to facilitate the flow of cleaning fluids along both an inside surface and an outer surface of each of the straws 102. Subsequent to conclusion of the washing process, a user may then grasp a handle 185 and/or 195 or 880 to remove the caddy 100 from the tray 500 or 510 and remove the straws 102 from the caddy 100 or 800.

While the invention has been described in terms of particular variations and illustrative figures, those of ordinary skill in the art will recognize that the invention is not limited to the variations or figures described. For example, specific examples are provided for shapes and materials; however, embodiments include those variations obvious to a person skilled in the art, such as changing a shape or combining materials together. Further, the features described with respect to one embodiment or variation may be used in other embodiments or variations. Processes described separately may be combined. In addition, where processes and steps described above indicate certain events occurring in certain order, those of ordinary skill in the art will recognize that the ordering of certain steps may be modified and that such modifications are in accordance with the variations of the invention. Additionally, certain of the steps may be performed concurrently in a parallel process when possible, as well as performed sequentially as described above. Therefore, to the extent there are variations of the invention, which are within the spirit of the disclosure or equivalent to the inventions found in the claims, it is the intent that this patent will cover those variations as well. Therefore, the present disclosure is to be understood as not limited by the specific embodiments described herein, but only by scope of the appended claims.

What is claimed is:

1. A caddy system for washing reusable drinking straws, comprising:

a guide plate;

a base plate; and one or more side pieces;

wherein the guide plate includes a first plurality of apertures configured to receive one or more reusable drinking straws, each of the first plurality of apertures include a lumen being tapered at an angle of at least two degrees (2°) from a vertical axis; and wherein the base plate includes a second plurality of apertures, each of the second plurality of apertures include a tapered lumen defining a lumen diameter downwardly expanding from a first lumen diameter to a second lumen diameter, the first lumen diameter being less than the second lumen diameter and disposed adjacent an upper surface of the base plate, the second lumen diameter disposed at a bottom surface of the base plate.

2. The caddy of claim 1, wherein the first plurality of apertures are configured to prevent a first reusable drinking straw, disposed in a first aperture of the first plurality of apertures, from touching a second reusable drinking straw disposed in an adjacent aperture of the first plurality of apertures.

3. The caddy of claim 1, wherein the guide plate and base plate are in a spaced apart configuration.

4. The caddy of claim 1, further comprises a reusable drinking straw of the reusable drinking straws being inserted through an aperture of the first plurality of apertures and is in closer proximity to a lower portion of the lumen of the aperture than an upper portion of the lumen of the aperture.

5. The caddy of claim 1, wherein one or more apertures of the first plurality of apertures further includes a tapered entrance at an upper end of the lumen of the one or more apertures.

6. The caddy of claim 1, further including a handle extending vertically from an upper side of the guide plate.

7. The caddy of claim 1, wherein the caddy includes one or more protrusions to maintain the base plate in a raised configuration.

8. A device for retaining reusable drinking straws, comprising:

a first plate including a first set of apertures and a second plate including a second set of apertures, wherein a lumen of an aperture of the first set of apertures is greater than a width of the aperture of the first set of apertures and wherein an aperture of the second set of apertures includes a lumen defining a double cone taper, the double cone taper extending from a first lumen diameter adjacent an upper surface of the second plate and progressively decreasing in cross sectional area to a second lumen diameter located at a mid-point of the lumen, and progressively increasing in cross sectional area from the second lumen diameter to a third lumen diameter adjacent a bottom surface of the second plate, the second lumen diameter being less than both the first lumen diameter and third lumen diameter;

one or more legs maintaining the first plate and the second plate in a spaced apart relationship; and a handle.

9. The caddy of claim 8, wherein the first set of apertures of the first plate substantially align with the second set of apertures of the second plate.

10. The caddy of claim 8, wherein one or more apertures of the first set of apertures of the first plate, and one or more apertures of the second set of apertures of the second plate include a tapered entrance.

11. The caddy of claim 8, wherein one or more of the second plurality of apertures of the second plate have a minimum lumen diameter that is smaller than both an outer diameter of a straw and a minimum diameter of the apertures of the first plate.

12. A method of using a caddy comprising:

providing a caddy including a guide plate, base plate and one or more side pieces, wherein the guide plate includes one or more apertures, and the base plate includes one or more apertures, an aperture of the one or more apertures of the base plate including a tapered lumen, defining a lumen diameter progressively expanding from a first diameter disposed adjacent a top surface of the base plate to a second diameter disposed adjacent a bottom surface of the base plate, the second diameter being larger than the first diameter;

placing at least one reusable straw within one of the one or more apertures in a guide plate of a caddy;

placing the caddy within a tray of a dishwashing machine, the upwards taper directing an upwards flow of cleaning fluids into a lumen of the reusable straw;

subsequent to a washing cycle ending, grasping a handle of the caddy to remove the caddy from the tray;

removing the at least one reusable straw from the caddy.

13. The method of claim 12, wherein the first set of apertures are configured to orientate straw parallel to a flow of cleaning fluids.

14. The method of claim 12, wherein the base plate includes a mesh structure.

15. The method of claim 12, wherein the one or more side pieces maintain the base plate in a raised configuration relative to the tray.

16. The method of claim 12, wherein the caddy further includes a handle extending from a top surface of the guide plate.

17. The method of claim 12, wherein at least one of the one or more apertures of the base plate further includes a tapered entrance for directing a downward flow of cleaning fluid along an outer surface of the at least one reusable straw.

18. The method of claim 12, wherein an aperture of the one or more apertures of the guide plate includes a tapered entrance.

19. The caddy of claim 8, wherein the second lumen diameter defines a minimum lumen diameter.

20. The caddy of claim 1, wherein an aperture of the second plurality of apertures includes a ridge extending along a portion of a periphery of an entrance of the aperture.

21. The caddy of claim 8, wherein an aperture of the second set of apertures includes a ridge extending along a portion of a periphery of an entrance of the aperture.

22. The method of claim 12, wherein an aperture of the one or more apertures of the base plate includes a ridge extending along a portion of a periphery of an entrance of the aperture.

* * * * *